US008262178B2

(12) United States Patent
Muhl

(10) Patent No.: US 8,262,178 B2
(45) Date of Patent: Sep. 11, 2012

(54) APPARATUS FOR CHANGING INK CARTRIDGES

(75) Inventor: Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 901 days.

(21) Appl. No.: 12/256,820

(22) Filed: Oct. 23, 2008

(65) Prior Publication Data

US 2009/0153638 A1 Jun. 18, 2009

(30) Foreign Application Priority Data

Dec. 17, 2007 (DE) ..... 10 2007 060 733

(51) Int. Cl.
*B41J 3/00* (2006.01)
*B41J 2/175* (2006.01)

(52) U.S. Cl. ..... 347/2; 347/85; 347/86

(58) Field of Classification Search ..... 347/2
See application file for complete search history.

(56) References Cited

U.S. PATENT DOCUMENTS

| | | | | |
|---|---|---|---|---|
| 5,440,979 | A | 8/1995 | Bonham et al. | |
| 5,467,709 | A | 11/1995 | Salomon | |
| 5,646,665 | A | 7/1997 | Swanson et al. | |
| 6,106,095 | A * | 8/2000 | Jackson et al. | 347/19 |
| 6,431,778 | B1 | 8/2002 | Coudray et al. | |
| 6,547,363 | B1 | 4/2003 | Shinada et al. | |
| 6,811,337 | B2 | 11/2004 | Hetzer et al. | |
| 7,314,271 | B2 | 1/2008 | Fukano et al. | |
| 2002/0063743 | A1 | 5/2002 | Eisner et al. | |
| 2006/0074818 | A1 | 4/2006 | Geserich | |
| 2006/0197800 | A1 | 9/2006 | Gerhardt | |
| 2008/0018705 | A1 | 1/2008 | Muhl | |

FOREIGN PATENT DOCUMENTS

| | | | |
|---|---|---|---|
| DE | 10051767 | A1 | 5/2002 |
| DE | 60032076 | T2 | 6/2007 |
| DE | 60309768 | T2 | 10/2007 |
| EP | 0622208 | A2 | 11/1994 |
| EP | 1114726 | A1 | 7/2001 |
| EP | 1 300 807 | B1 | 4/2003 |
| EP | 1698469 | A2 | 9/2006 |
| EP | 1352749 | B1 | 11/2006 |
| EP | 1880857 | A2 | 1/2008 |
| FR | 2790997 | A | 9/2000 |
| GB | 2272401 | A | 5/1994 |

OTHER PUBLICATIONS

European Search Report dated Apr. 7, 2009.

* cited by examiner

*Primary Examiner* — Uyen Chau N Le
*Assistant Examiner* — Kajli Prince
(74) *Attorney, Agent, or Firm* — Laurence A. Greenberg; Werner H. Stemer; Ralph E. Locher

(57) ABSTRACT

An apparatus for changing ink cartridges of a printing apparatus having a transport apparatus for flat goods, a pressing apparatus and a printing module. The transport apparatus is disposed in a stationary manner in the printing apparatus opposite a pressing apparatus which presses an item of mail onto a transport belt. The transport belt, in a transport region, acts with a predetermined adhesive friction on a part of a surface of the item of mail which is not printed but is close to a region to be printed. A change position for ink cartridges is located before the transport region on a front side of the printing apparatus or above the transport region of an appropriately constructed transport apparatus.

7 Claims, 5 Drawing Sheets

APPARATUS FOR CHANGING INK CARTRIDGES

CROSS-REFERENCE TO RELATED APPLICATION

This application claims the priority, under 35 U.S.C. §119, of German Patent Application DE 10 2007 060 733.6, filed Dec. 17, 2007; the prior application is herewith incorporated by reference in its entirety.

BACKGROUND OF THE INVENTION

Field of the Invention

The invention relates to an apparatus for changing ink cartridges of a printing apparatus having a transport apparatus for flat goods, a pressing apparatus and a printing module. The transport apparatus is disposed in a stationary manner in the printing apparatus opposite a pressing apparatus which presses an item of mail onto a transport belt of the transport apparatus. The transport belt acts in a transport region with a predetermined adhesive friction on a part of the surface of the item of mail which is not printed but is close to a region to be printed. The invention is used in microprocessor-controlled printers and is suitable for franking machines and other mail processing appliances. The invention permits short travel times to be accomplished from a printing position to a change position.

European Patent EP 1 300 807 B1, corresponding to U.S. Pat. No. 6,811,337 B2, has disclosed a method for opening a security housing for a franking machine which, through the use of a transverse movement of a printing module provided by a transverse movement device, is moved into an unlocking position for unlocking the security housing or into a change position. In that case, the printing module is moved transversely with respect to the transport direction of items of mail, i.e. in the direction of a rear wall of the franking machine, in order to mechanically expose an access in the security housing as a result thereof for the purpose of changing ink cartridges.

The ink cartridge includes an inkjet printhead, an ink container and a contact making area. The ink container is located in a bulge or expansion in the housing of the ink cartridge, which makes up about two thirds of the extent of the ink cartridge in the transverse movement direction. In the printing position, those two thirds dip into a transport drum, which is closed on the front side and open in the direction of the rear wall of the franking machine. The remaining third of the housing of the ink cartridge encloses the inkjet printhead and projects out of the transport drum and is aimed at the top of the item of mail which is to be printed with the postal indicia in accordance with a known inkjet printing process. In order to ensure that a cleaning position for the inkjet printhead can be reached quickly, the cleaning position lies between the printing position and the change position. In the 600 dpi ½ inch ink cartridges being used nowadays, in each case two ink cartridges are used, which are disposed in a printing carriage offset in relation to each other by one printhead width in the transverse movement direction. The two ink cartridges, the printing carriage and contact making and drive electronics form the printing module. As a result of the enclosure of the inkjet printhead by the housing of the ink cartridge, the extent of that third of the ink cartridge in the transverse movement direction in ink cartridges from the Hewlett-Packard Co. is approximately 20 mm. Thus, during the transverse movement of a printing module, a distance of substantially more than two thirds of the extent of the ink cartridge is covered before an access is exposed mechanically for the purpose of changing ink cartridges. In the event of a horizontal transport of flat goods or items of mail, it is assumed that at least one ink cartridge is disposed above a printing window in the z direction of a Cartesian coordinate system, i.e. counter to the direction of the force of gravity. During printing, an inkjet printhead expels ink drops in the direction of the force of gravity, which drops fly through the printing window. The printing window is disposed at the edge of a transport belt in the y direction in a housing part, with the transport belt transporting a flat item of goods to be printed at the edge in the transport direction x past the at least one printhead during the printing.

The extent of the printing apparatus in the y direction results from the number of different positions into which a printing module can be moved by a transverse movement. The security housing is already relatively large because of the transport drum and the access. In order to change the ink cartridges, after the release of the closure in the printing module, the ink cartridges have to be tilted forward in order to release the contacts for the contact making and drive electronics. The accessibility is determined by the size of the housing opening of the access for changing ink cartridges.

A compact transport apparatus for items of mail is needed in the market segment of franking machines with small to moderate throughput of items of mail.

SUMMARY OF THE INVENTION

It is accordingly an object of the invention to provide an apparatus for changing ink cartridges, which overcomes or avoids the hereinafore-mentioned disadvantages of the heretofore-known devices of this general type and which permits rapid access for the purpose of changing ink cartridges as well as good accessibility to the ink cartridges.

In addition, the intention is to achieve high printing quality with low manufacturing costs and with a moderate throughput of items of mail, without the reliability of the printing apparatus being impaired thereby. Firstly, postcards and, secondly, C4 size letters with a letter thickness of up to 10 mm are to be processed. The printing offset in the x direction and y direction should be low, less than 100 μm in both directions.

With the foregoing and other objects in view there is provided, in accordance with the invention, in a printing apparatus including a transport apparatus being stationary in the printing apparatus and having a transport belt for flat goods, a pressing apparatus disposed opposite the transport apparatus for pressing an item of mail onto the transport belt, and a printing module, the transport belt acting in a transport region with a predetermined adhesive friction on a part of a surface of the item of mail not being printed but being close to a region to be printed, the improvement comprising an apparatus for changing ink cartridges of the printing apparatus. The changing apparatus includes a change position for the ink cartridges disposed before the transport region on a front side of the printing apparatus or above the transport region of the appropriately constructed transport apparatus.

A printing position is reached through the use of a transverse movement of a printing module transversely with respect to the transport direction of items of mail provided by a transverse movement device. In the case of printing in accordance with an inkjet printing process, the printing module is kept in the printing position and a transport apparatus for items of mail is disposed appropriately in order to transport the item of mail horizontally past the printhead. The transport apparatus for items of mail is disposed in a stationary manner in the printing apparatus opposite a pressing apparatus, which presses the item of mail onto the transport belt.

In the transport region, the transport belt acts with a predetermined adhesive friction on a part of the surface of the item of mail which is not printed but is close to the region to be printed.

Provision is made for a change position for ink cartridges to be located before the transport region on the front side of the printing apparatus or above the transport region of an appropriately constructed transport apparatus. Advantageously and as distinct from the previous known apparatuses, the printing module no longer has to be moved back in the y direction out of the printing position through the use of a transverse movement device in order to be able to reach the change position for ink cartridges. As a result, the extent of the printing apparatus in the y direction becomes minimal. At the same time, the accessibility to the ink cartridges is improved. The printing apparatus is, in particular, a component part of a franking machine.

In accordance with another feature of the invention, the transport belt is preferably a driven, wide, tensioned flat belt. According to a first variant, the latter is guided along, both over the printing module and under the printing module through the use of deflection rollers while the printing module is located in a printing position. In order to change ink cartridges, the printing module is moved through the use of a transverse movement device transversely with respect to the transport direction of items of mail, starting from the printing position, to a change position on the front side of the printing apparatus. The transverse movement device is constructed appropriately for this purpose.

In accordance with a concomitant feature or second variant of the invention, the flat belt is always guided back and forth under the printing module or at least under parts thereof, and the change position is identical to the printing position. The transport apparatus is constructed in such a way that the printing module can remain in the printing position. An access in the security housing is exposed in order to change ink cartridges. Therefore, the extent of the printing apparatus in the y direction is then minimal.

Other features which are considered as characteristic for the invention are set forth in the appended claims.

Although the invention is illustrated and described herein as embodied in an apparatus for changing ink cartridges, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
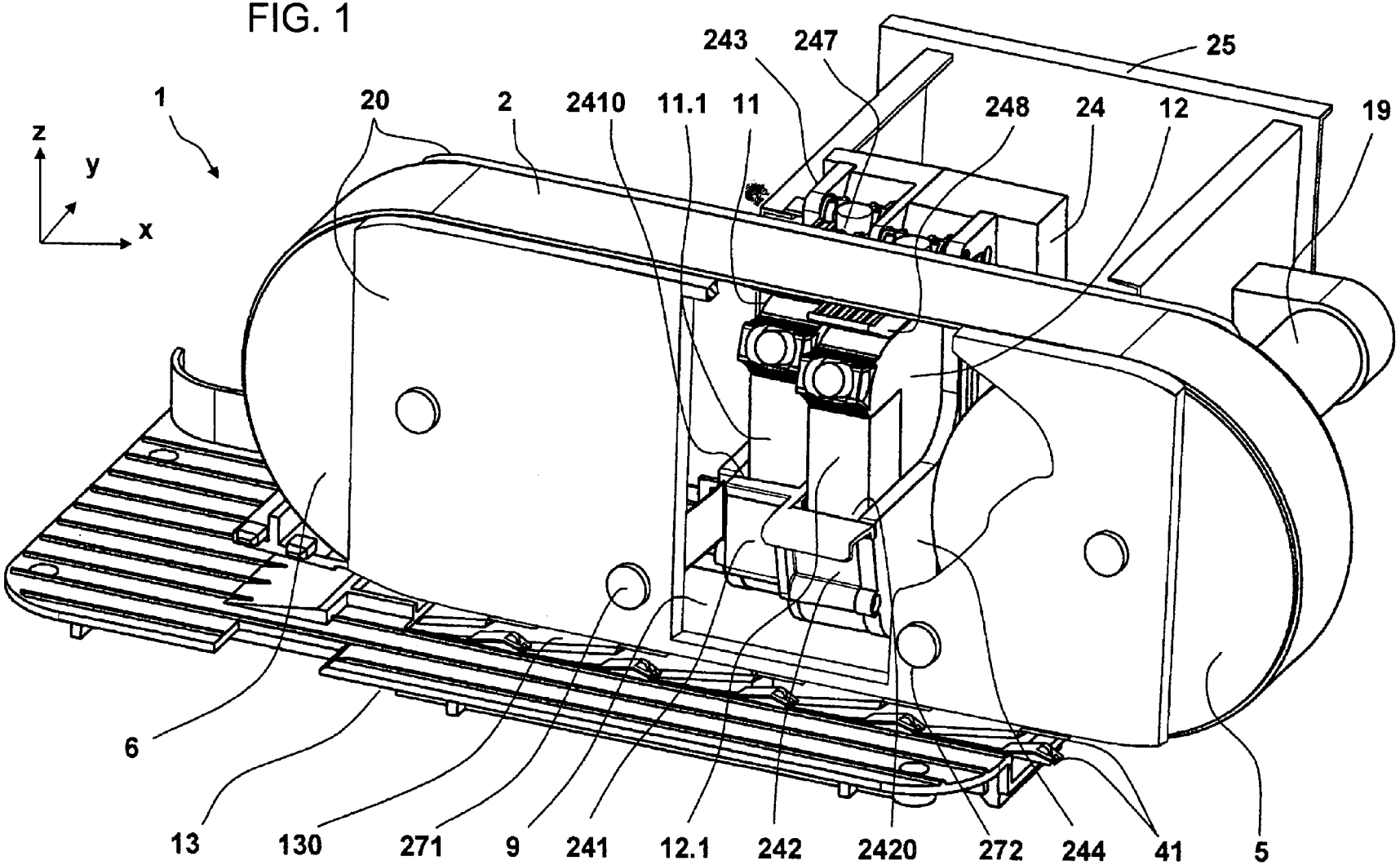
FIG. 1 is a diagrammatic, perspective view of a transport apparatus according to a first variant with a printing module in a printing position.

Referring now to the figures of the drawings in detail and first, particularly, to FIG. 1 thereof, there is seen a perspective view of a transport apparatus 1 for flat goods or items of mail according to a first variant of the invention, which is illustrated with a printing module in a printing position. The transport apparatus 1 for items of mail is an important component part of a franking machine and is disposed above a feed table 13. A non-illustrated pressing apparatus, which presses in opposition in a resilient or sprung manner from below, is disposed underneath the feed table and acts in a z direction through an opening 130 in the feed table 13.

As is known, a franking machine includes, inter alia, a non-illustrated electronic part (a meter) and the transport apparatus for items of mail with a non-illustrated electronic controller. A keyboard and a display unit of the meter are connected to the electronic part in a non-illustrated manner. The electronic controller is connected electrically to a drive 19 of the transport apparatus for items of mail in order to drive it. An electric motor with a gearbox may be used, for example, for the drive. The transport apparatus 1 has a transport belt 2, which is formed as a flat belt.

The flat belt 2 acts, in a transport region, with a predetermined adhesive friction on a part of a surface of the flat goods or items of mail which is not printed, but is close to a printing region. The flat belt 2 of the transport apparatus 1 for items of mail has a high transverse stiffness and is led over two deflection rollers 5 and 6. In this case, the flat belt 2 runs under a printing module on one side and is led back over the printing module on the other side. As is known, the printing module includes a printing carriage 24, non-illustrated contact making and drive electronics on a rear side of the printing carriage 24, and at least one printhead, for example an ink cartridge with an integrated inkjet printhead. The printing carriage 24 in the illustrated example according to FIG. 1 preferably carries two ink cartridges 11, 12, which are offset in relation to each other in x and y directions. Alternatively, the use of a plurality of ink cartridges is also possible. The printing carriage 24 has a respective opening 2410, 2420 for insertion of each of the ink cartridges 11, 12, which are bounded on the sides by right-hand and left-hand side plates 244 and 243, at the bottom by a carrier molding and on the rear side by a contact area of the contact making and drive electronics. The carrier molding includes two halves, namely a first half 241 being equipped with the first opening 2410 for the insertion of the first ink cartridge 11 and a second half 242 being equipped with the second opening 2420 for the insertion of the second ink cartridge 12 and being offset in the x direction in relation to the first half. The first carrier molding half 241 is also offset in the y direction in relation to the second half. Each opening is closed at the top by a respective closure lever 247, 248 for each cartridge. In the printing position, the printing module projects into an interspace between the deflection rollers 5 and 6, with the inkjet printheads of the two ink cartridges 11, 12 being located outside the transport region and being disposed above a non-illustrated printing window, counter to the direction of the force of gravity in the z direction of a Cartesian coordinate system. Bulges or expansions 11.1, 12.1 of the two ink cartridges 11, 12 are located within the interspace between the deflection rollers 5 and 6, above a supporting plate 9. The printing position is located between a change or exchanging position and a cleaning and sealing position. In order to change the ink cartridges in an upward direction, the printing module is moved forward out of the transport apparatus for items of mail, into the change position.

Figure 2:
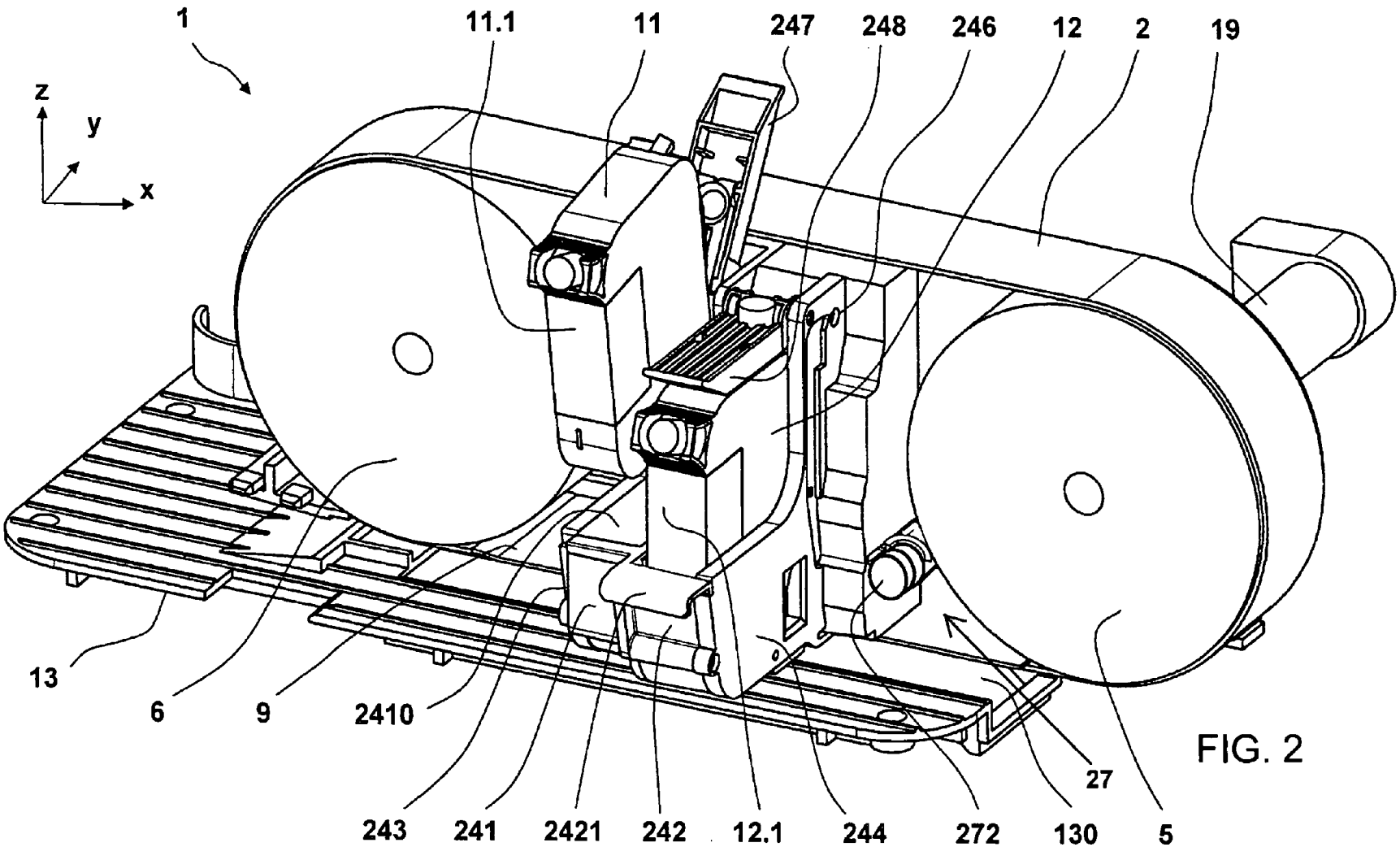
FIG. 2 is a perspective view of a transport apparatus according to the first variant with a printing module withdrawn in a change position.

FIG. 2 illustrates a perspective view of the transport apparatus 1 for items of mail according to the first variant of the invention, with the printing module withdrawn in the change position. Slide rods 271 (hidden in FIG. 2 but shown in FIG. 1) and 272 of a transverse movement device 27, on which the printing carriage 24 is supported and guided, are disposed in the vicinity of the deflection rollers 5 and 6 and therebetween. The printing carriage can be pulled or alternatively moved forward into the change position through the use of a handle 2421. The rest of the structure corresponds to the aforementioned structure already explained. One of the two closure levers, namely the closure lever 247, is shown opened. The carrier molding of the printing carriage 24, disposed at the bottom, leaves the printing carriage openings 2410, 2420 open at the front toward the upper half of the front side.

The ink cartridge 11 can therefore be removed forward and upward, since the closure lever 247 has been pivoted upward. The other closure lever 248 is shown unopened. In order to open the closure lever 248, it must likewise be pivoted upward about an axis of rotation 246.

The handle 2421 is integrally molded on the second half of the carrier molding of the printing carriage 24. Alternatively, a handle can be integrally molded on the first half or the first half and second half of the carrier molding.

Figure 3:
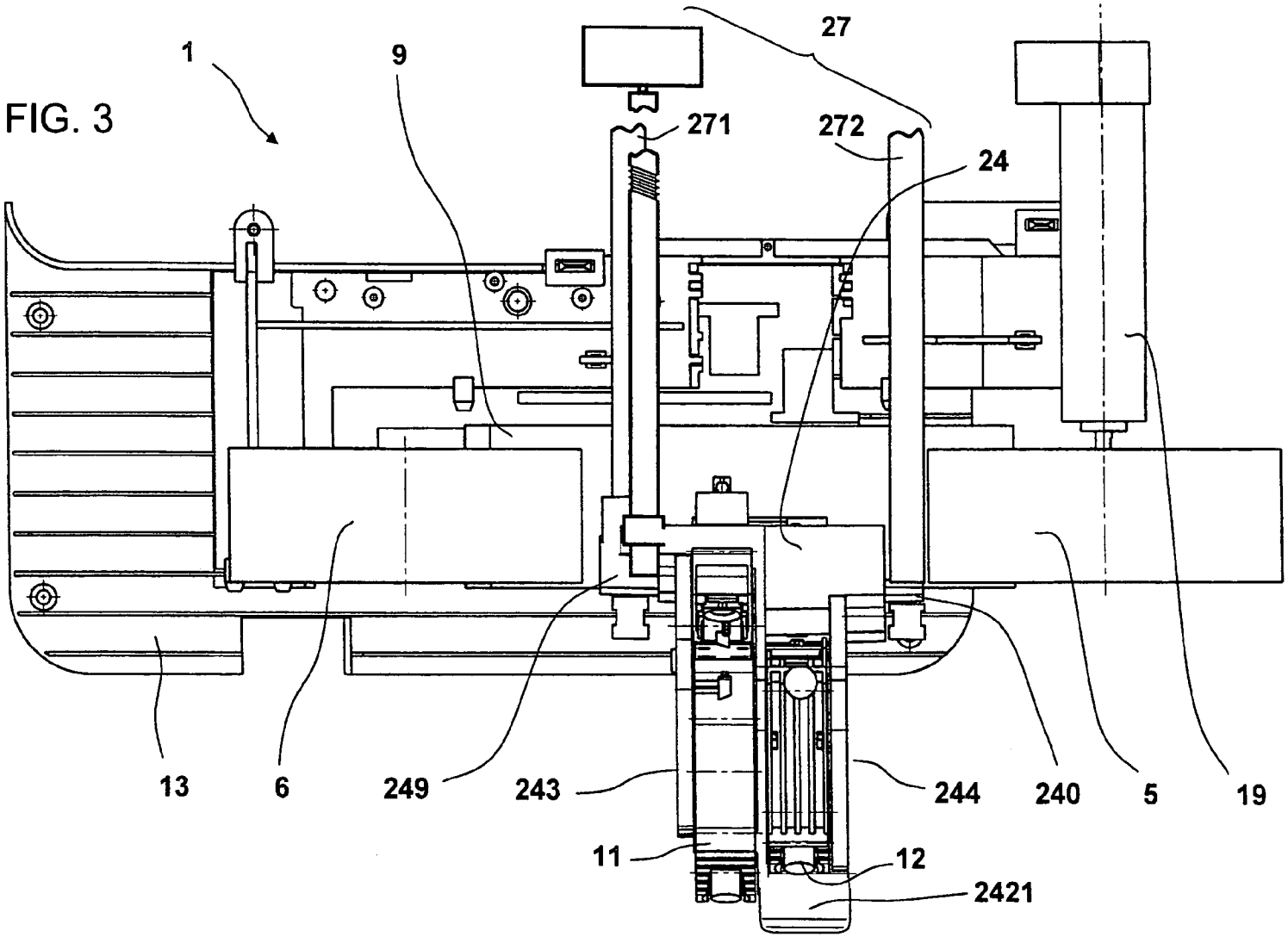
FIG. 3 is a top-plan view of the transport apparatus according to the first variant with a printing module withdrawn in the change position.

FIG. 3 is a plan view of the transport apparatus 1 according to the first variant of the invention, which is illustrated in the change position with the printing module withdrawn. In the illustration, the transport belt has been omitted in order to permit otherwise hidden parts to become visible. It is pointed out that the roller carrier, the deflection rollers and the transport belt are constituent parts of the transport apparatus 1.

Both the transverse movement device 27 and the printing module are constructed to carry out a transverse movement, which is to say counter to the y direction. In one embodiment, a non-illustrated electric motor, preferably a stepping motor, is used as a drive for the transverse movement device 27. In a preferred embodiment, the electric motor can be omitted. The transverse movement can be carried out under hand lever operation, which reduces manufacturing costs.

A guiding and sliding piece 249, which can slide on the slide rod 271, is integrally molded on the left-hand side wall of the first half 241 of the carrier molding of the printing carriage 24 of the printing module. A sliding piece 240, which can slide on the slide rod 272, is integrally molded on the right-hand side wall of the second half 242 of the carrier molding of the printing carriage 24 of the printing module. The slide rods 271, 272 are preferably formed of metal.

The printing carriage of the printing module is appropriately constructed to be moved transversely with respect to the transport direction of items of mail, starting from the printing position, to a change position on the front side of the printing apparatus. The printing carriage 24 slides with the guiding and sliding piece 249 and the sliding piece 240 on the two slide rods 271, 272, which are fixed at the rear to a rear wall of a non-illustrated chassis and at the front to a mounting plate of a non-illustrated roller carrier for the deflection rollers 5 and 6. FIG. 1 shows a roller carrier 20 with a mounting plate on its front side, and a chassis with a rear wall 25.

Figure 4:
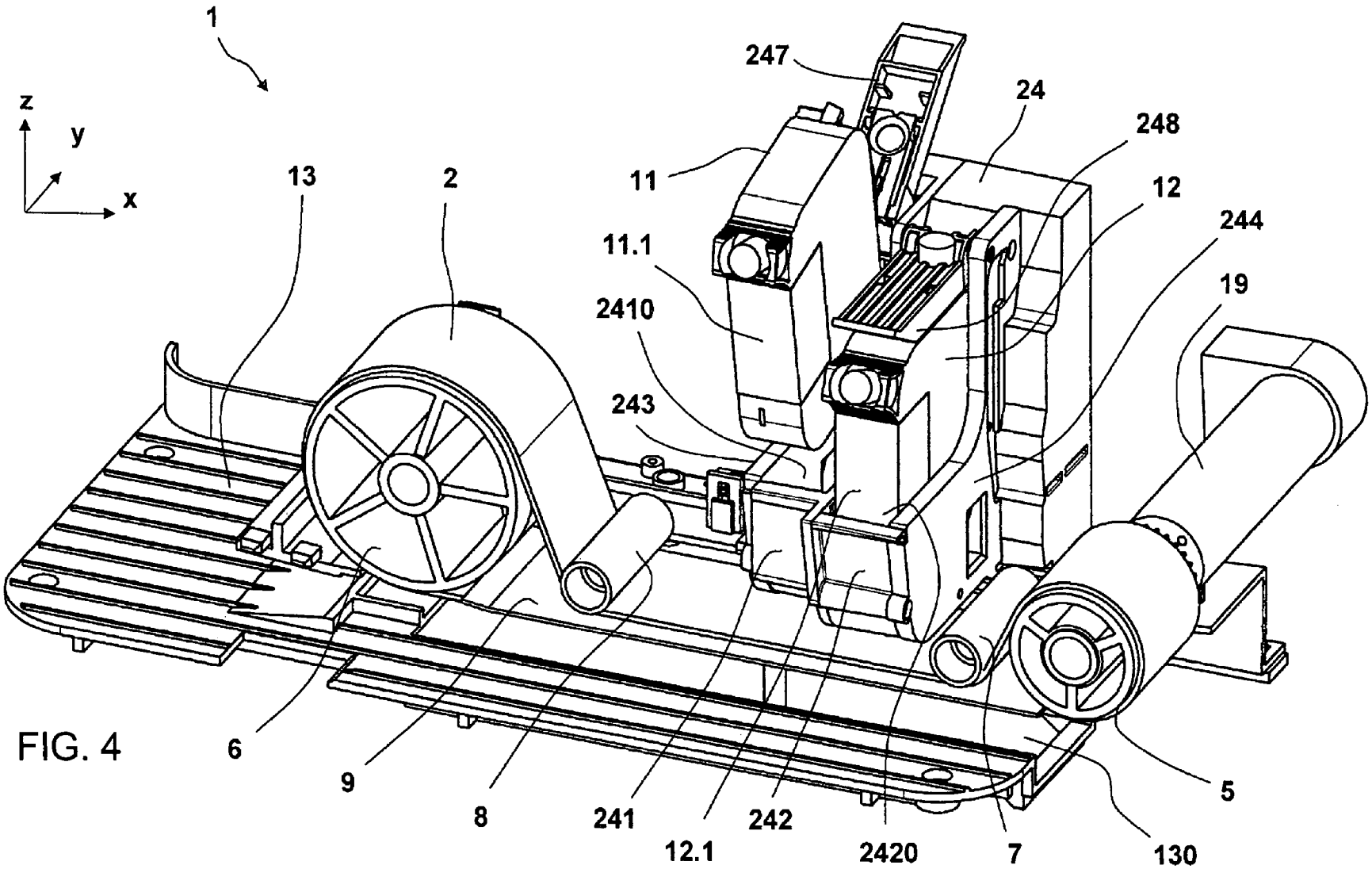
FIG. 4 is a perspective view of a transport apparatus according to a second variant with a printing module in a printing and change position.

FIG. 4 is a perspective view of a transport apparatus 1 for items of mail according to a second variant of the invention, which is illustrated with a printing module in the printing and change position. The flat belt 2 is guided along over a plurality of deflection rollers 5, 6, 7 and 8 completely under the printing module or parts thereof. The flat belt 2 is tensioned between the two outer deflection rollers 5, 6 under a supporting plate 9 and between the two inner deflection rollers 7, 8 above the supporting plate 9. As a result, the loop-like course of the transport belt 2 (flat belt) is indented from above in order to create space for the printing module. The printing carriage 24 of the printing module has the openings 2410, 2420 for the insertion of each of the ink cartridges 11, 12, which are bounded on the sides by the right-hand and left-hand side plates 244 and 243, at the bottom by the carrier molding and on the rear side by the contact area of the contact making and drive electronics. The carrier molding includes the two halves 241 and 242, which are offset in relation to each other, and is constructed in such a way that the ink cartridges 11, 12 can be inserted with the bulge 11.1, 12.1 at the front. Closure levers 248, 247 are each rotatably fixed to a respective one of the right-hand and left-hand side plates 244 and 243. The right-hand outer deflection roller 5 is driven by the drive 19. The non-illustrated pressing apparatus, which presses in opposition in a resilient or sprung manner from below, acts in the z direction through an opening 130 in the feed table on the items of mail, which are transported in the x direction through the use of the transport apparatus 1.

Figure 5:
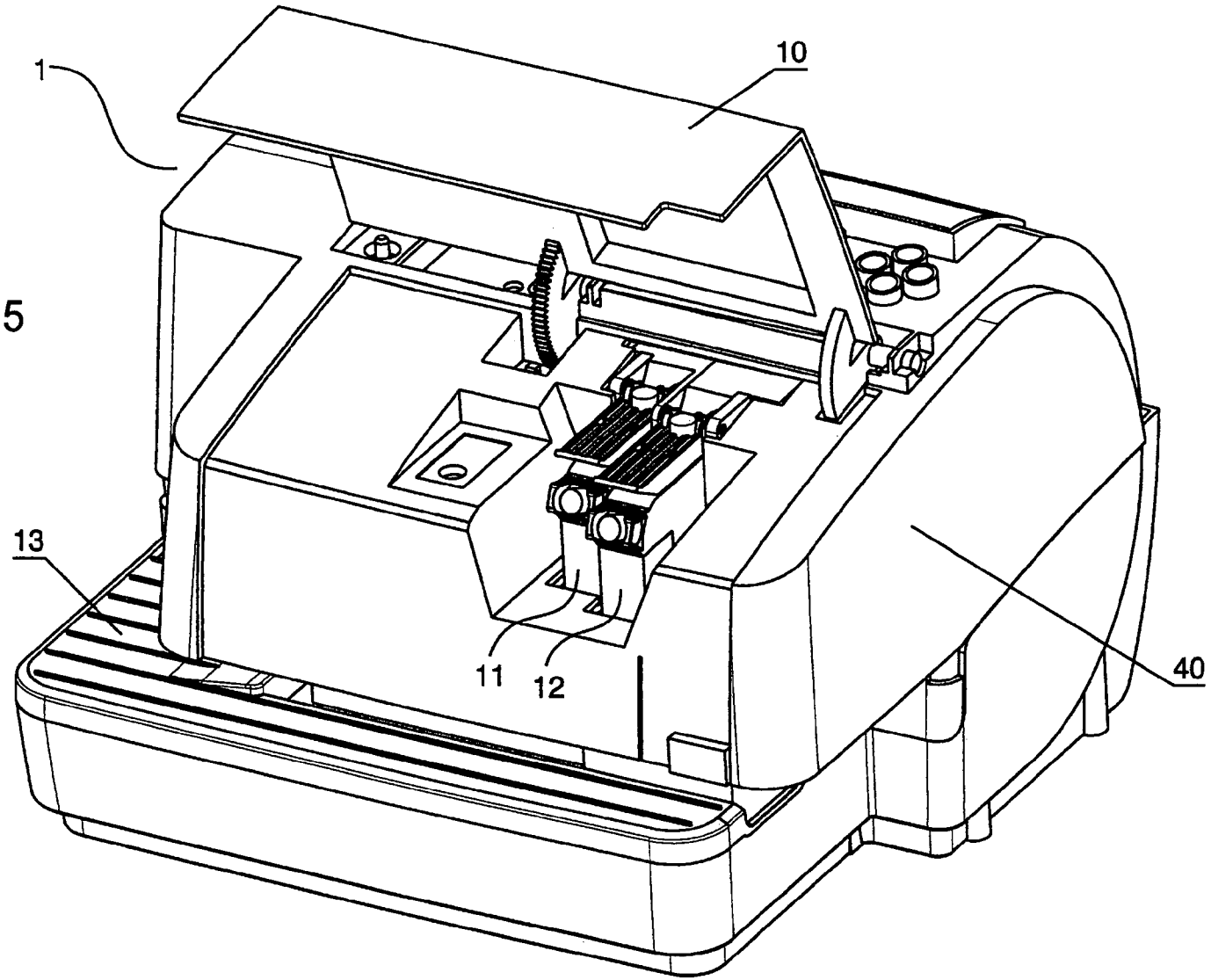
FIG. 5 is a perspective view of a franking machine with a flap to be opened upward.

FIG. 5 shows a perspective view of a franking machine 40 with a flap 10 to be opened upward. The apparatus 1 for transporting items of mail is disposed at the franking machine 40 and above the feed table 13. The ink cartridges 11, 12 are constituent parts of the printing module.

The printing module can remain in the printing position as it is changed and the ink cartridges can be removed directly upward without the printing module having to be moved into another position.

Alternatively, provision is made for a housing for the printing apparatus to be constructed for the replacement of the ink cartridges and to have a flap to be opened forward, as well as for the printing apparatus to be a constituent part of a franking machine. The housing may have a flap at the front of the housing, as is the case in a known franking machine of the type T1000 produced by the manufacturer Francotyp-Postalia GmbH of Germany. This flap configuration at the housing could be maintained if the thermo-transfer printing device of the franking machine were to be replaced with an inkjet printing device.

The printing carriage could then be moved forward, as shown in FIG. 3. The housing has a flap to be opened forward in order to replace the ink cartridges.

Alternatively, this also applies to a franking machine of the Optimal type produced by the manufacturer Francotyp-Postalia GmbH of Germany, which has a flap at the front of the housing to be opened obliquely upward, in such a way that a franking machine could be provided with a comparable housing, however with an ink jet printing device, in which its housing is constructed for replacing the ink cartridges and has a flap to be opened forward and upward.

The printing apparatus with the apparatus for changing ink cartridges is also suitable for other mail processing appliances.

The invention is not restricted to the present embodiment. Instead, a number of appliances may be used which start from the same basic concept of the invention, are conceivable within the scope of the claims and are covered by the appended claims.

The invention claimed is:

1. In a printing apparatus including a stationary transport apparatus with a transport belt for flat goods, a pressing apparatus disposed opposite the transport apparatus for pressing an item of mail onto the transport belt, and a printing module, the transport belt acting in a transport region with a predetermined adhesive friction on a part of a surface of the item of mail not being printed but being close to a region to be printed, the improvement comprising:

an apparatus for changing ink cartridges of the printing apparatus, the apparatus including a change position for the ink cartridges disposed before the transport region on a front side of the printing apparatus or above the transport region of the transport apparatus;

deflection rollers for the transport belt, said deflection rollers having a roller carrier with a mounting plate;

a chassis having a rear wall;

two slide rods being fixed at the rear to said rear wall and at the front to said mounting plate;

the printing module having a printing carriage with a guiding and sliding piece and a sliding piece sliding on said two slide rods; and said roller carrier, said deflection rollers and the transport belt being components of the transport apparatus.

2. The printing apparatus according to claim 1, which further comprises:

said deflection rollers guiding along the transport belt in the form of a driven, wide, tensioned flat belt both over the printing module and under the printing module with the printing module disposed in a printing position; and a transverse movement device configured to move the printing module transversely relative to a transport direction of items of mail, starting from the printing position to said change position on the front side of the printing apparatus.

3. The printing apparatus according to claim 1, wherein the printing module has a printing carriage configured to be moved transversely relative to a transport direction of items of mail, starting from the printing position to said change position on the front side of the printing apparatus.

4. The printing apparatus according to claim 1, wherein the printing module has a printing carriage with a handle.

5. The apparatus according to claim 4, wherein said printing carriage has a molding with first and second halves, and said handle is integrally molded on said second half.

6. The printing apparatus according to claim 1, which further comprises a housing for the printing apparatus being configured for replacement of the ink cartridges and having a flap to be opened at least one of forward or upward.

7. In a printing apparatus including a stationary transport apparatus with a transport belt for flat goods, a pressing apparatus disposed opposite the transport apparatus for pressing an item of mail onto the transport belt, and a printing module, the transport belt acting in a transport region with a predetermined adhesive friction on a part of a surface of the item of mail not being printed but being close to a region to be printed, the improvement comprising:

an apparatus for changing ink cartridges of the printing apparatus, the apparatus including a change position for the ink cartridges disposed before the transport region on a front side of the printing apparatus or above the transport region of the transport apparatus;

deflection rollers for the transport belt, said deflection rollers having a roller carrier with a mounting plate;

a chassis having a rear wall;

two slide rods being fixed at the rear to said rear wall and at the front to said mounting plate;

the printing module having a printing carriage with a guiding and sliding piece and a sliding piece sliding on said two slide rods;

said roller carrier, said deflection rollers and the transport belt being components of the transport apparatus;

a traverse movement device configured to move the printing module to the printing or change position, said printing position being identical to the change position; and the transport belt is a driven, wide, tensioned flat belt, and the flat belt is always guided back and forth under at least parts of the printing module.

* * * * *